US012342853B2

(12) United States Patent
Ferrie et al.

(10) Patent No.: US 12,342,853 B2
(45) Date of Patent: Jul. 1, 2025

(54) SMOKING SUBSTITUTE CONSUMABLE

(71) Applicant: Imperial Tobacco Limited, Bristol (GB)

(72) Inventors: Kate Ferrie, Liverpool (GB); Ross Shenton, Liverpool (GB); Jill Jones, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 359 days.

(21) Appl. No.: 17/849,990

(22) Filed: Jun. 27, 2022

(65) Prior Publication Data

US 2022/0322735 A1 Oct. 13, 2022

Related U.S. Application Data

(63) Continuation of application No. PCT/EP2020/087205, filed on Dec. 18, 2020.

(30) Foreign Application Priority Data

Dec. 31, 2019 (EP) ..... 19220258
Dec. 31, 2019 (EP) ..... 19220266
(Continued)

(51) Int. Cl.
*A24D 1/20* (2020.01)
*A24D 1/04* (2006.01)
(Continued)

(52) U.S. Cl.
CPC ..... *A24D 1/20* (2020.01); *A24D 1/04* (2013.01); *A24D 3/04* (2013.01); *A24D 3/17* (2020.01); *A24F 40/20* (2020.01); *A24F 40/46* (2020.01)

(58) Field of Classification Search
None
See application file for complete search history.

(56) References Cited

U.S. PATENT DOCUMENTS

2014/0305448 A1 10/2014 Zuber et al.
2017/0042221 A1 2/2017 England
(Continued)

FOREIGN PATENT DOCUMENTS

CN 1138438 A 12/1996
CN 204707983 U 10/2015
(Continued)

OTHER PUBLICATIONS

CN-107772530-A, English machine translation, PE2E (Year: 2018).*
(Continued)

*Primary Examiner* — Michael H. Wilson
*Assistant Examiner* — Michael T Fulton
(74) *Attorney, Agent, or Firm* — Dykema Gossett PLLC

(57) ABSTRACT

An aerosol-forming article is disclosed having an improved filter at its axial downstream end, for instance a mouthpiece end. The improved filter comprises a filter segment having a plurality of bores extending there through, wherein a cooling segment is arranged upstream of the filter segment, the cooling segment comprising portion having a central bore that forms a central region extending around a central axis of the aerosol-forming article and a center of each bore of the plurality of bores is arranged radially outside of the central region.

15 Claims, 3 Drawing Sheets

(30) Foreign Application Priority Data

Dec. 31, 2019 (EP) ..... 19220272
Dec. 31, 2019 (EP) ..... 19220273

(51) Int. Cl.

| | |
|---|---|
| ***A24D 3/04*** | (2006.01) |
| ***A24D 3/17*** | (2020.01) |
| ***A24F 40/20*** | (2020.01) |
| ***A24F 40/46*** | (2020.01) |

(56) References Cited

U.S. PATENT DOCUMENTS

| | | | | |
|---|---|---|---|---|
| 2018/0064161 | A1 | 3/2018 | Kaihatsu et al. | |
| 2018/0317554 | A1 * | 11/2018 | Kaufman | H05B 6/105 |

FOREIGN PATENT DOCUMENTS

| | | | | | |
|---|---|---|---|---|---|
| CN | 107772530 | A * | 3/2018 | | A24D 3/04 |
| CN | 108185517 | A | 6/2018 | | |
| CN | 108 323 799 | A | 7/2018 | | |
| EP | 1 072 201 | A2 | 1/2001 | | |
| EP | 3 295 811 | A1 | 3/2018 | | |
| EP | 3494809 | A1 * | 6/2019 | | A24D 1/20 |
| WO | WO 2013/098405 | A2 | 7/2013 | | |
| WO | WO 2013/098409 | A1 | 7/2013 | | |
| WO | WO 2015/166245 | A2 | 11/2015 | | |
| WO | WO 2019/123646 | A1 | 6/2019 | | |
| WO | WO 2019/227603 | A1 | 12/2019 | | |

OTHER PUBLICATIONS

International Search Report and Written Opinion (PCT/EP2020/087205), dated Apr. 12, 2021, 15 pages.
International Search Report (19220258.8-1004), dated Jul. 7, 2020, 8 pages.
International Search Report (19220266.1-1004), dated Jul. 10, 2020, 10 pages.
International Search Report (19220272.9-1004), dated Jul. 10, 2020, 9 pages.
International Search Report (19220273.7-1004), dated Jul. 7, 2020, 8 pages.

* cited by examiner

SMOKING SUBSTITUTE CONSUMABLE

CROSS-REFERENCE TO RELATED APPLICATIONS/INCORPORATION BY REFERENCE STATEMENT

This application is a non-provisional application claiming benefit to the international application no. PCT/EP2020/087205 filed on Dec. 18, 2020, which claims priority to EP 19220258.8 filed on Dec. 31, 2019, EP 19220266.1 filed on Dec. 31, 2019, EP 19220272.9 filed on Dec. 31, 2019, and EP 19220273.7 filed on Dec. 31, 2019. The entire contents of each of the above-referenced applications are hereby incorporated herein by reference in their entirety.

FIELD OF THE DISCLOSURE

The present disclosure relates to a consumable for use in a smoking substitute system and particularly, although not exclusively, to a heat-not-burn (HNB) consumable.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Conventional combustible smoking articles, such as cigarettes, typically comprise a cylindrical rod of tobacco comprising shreds of tobacco which is surrounded by a wrapper, and usually also a cylindrical filter axially aligned in an abutting relationship with the wrapped tobacco rod. The filter typically comprises a filtration material which is circumscribed by a plug wrap. The wrapped tobacco rod and the filter are joined together by a wrapped band of tipping paper that circumscribes the entire length of the filter and an adjacent portion of the wrapped tobacco rod. A conventional cigarette of this type is used by lighting the end opposite to the filter, and burning the tobacco rod. The smoker receives mainstream smoke into their mouth by drawing on the mouth end or filter end of the cigarette.

Combustion of organic material such as tobacco is known to produce tar and other potentially harmful by-products. There have been proposed various smoking substitute systems (or "substitute smoking systems") in order to avoid the smoking of tobacco.

Such smoking substitute systems can form part of nicotine replacement therapies aimed at people who wish to stop smoking and overcome a dependence on nicotine.

Smoking substitute systems include electronic systems that permit a user to simulate the act of smoking by producing an aerosol (also referred to as a "vapor") that is drawn into the lungs through the mouth (inhaled) and then exhaled. The inhaled aerosol typically bears nicotine and/or flavorings without, or with fewer of, the odor and health risks associated with traditional smoking.

In general, smoking substitute systems are intended to provide a substitute for the rituals of smoking, whilst providing the user with a similar experience and satisfaction to those experienced with traditional smoking and with combustible tobacco products. Some smoking substitute systems use smoking substitute articles that are designed to resemble a traditional cigarette and are cylindrical in form with a mouthpiece at one end.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories.

There are a number of different categories of smoking substitute systems, each utilizing a different smoking substitute approach.

One approach for a smoking substitute system is the so-called "heat not burn" ("HNB") approach in which tobacco (rather than an "e-liquid") is heated or warmed to release vapor. The tobacco may be leaf tobacco or reconstituted tobacco. The vapor may contain nicotine and/or flavorings. In the HNB approach the intention is that the tobacco is heated but not burned, i.e., the tobacco does not undergo combustion.

A typical HNB smoking substitute system may include a device and a consumable. The consumable may include the tobacco material. The device and consumable may be configured to be physically coupled together. In use, heat may be imparted to the tobacco material by a heating element of the device, wherein airflow through the tobacco material causes moisture in the tobacco material to be released as vapor. A vapor may also be formed from a carrier in the tobacco material (this carrier may for example include propylene glycol and/or vegetable glycerin) and additionally volatile compounds released from the tobacco. The released vapor may be entrained in the airflow drawn through the tobacco.

As the vapor passes through the consumable (entrained in the airflow) from an inlet to a mouthpiece (outlet), the vapor cools and condenses to form an aerosol for inhalation by the user. The aerosol will normally contain the volatile compounds.

Typically, the consumable of the HNB smoking substitute system is an aerosol forming article having an aerosol-forming substrate disposed at the inlet end. A heater of a device, for instance a smoking substitute device, may in some instances be arranged to penetrate the aerosol-forming substrate during use. Said penetration may disturb the aerosol-forming substrate causing tobacco or other materials to be dislodged into the airflow. Consequently, it is known to provide an acetate filter tow at the mouthpiece to filter the airflow to prevent any material from entering the user's mouth. Acetate filter tows are known in the art and form a close knit bundle of fibers through which the airflow is drawn. The bundle of fibers provides a filter to catch debris from the aerosol-forming substrate.

In HNB smoking substitute systems, heating as opposed to burning the tobacco material is believed to cause fewer, or smaller quantities, of the more harmful compounds ordinarily produced during smoking. Consequently, the HNB approach may reduce the odor and/or health risks that can arise through the burning, combustion and pyrolytic degradation of tobacco.

There is a need for improved design of HNB consumables to enhance the user experience and improve the function of the HNB smoking substitute system. Specifically, it is an aim of the present disclosure to provide a consumable having an improved nicotine delivery and/or Total Particulate Matter (TPM) delivery and/or flavor delivery and/or airflow delivery to the user.

The present disclosure has been devised in the light of the above considerations.

SUMMARY OF THE DISCLOSURE

At its most general, the present disclosure relates to an aerosol-forming article, e.g., a smoking substitute article such as an HNB consumable having an improved filter at its axial downstream end, for instance a mouthpiece end. The improved filter comprises a filter segment having a plurality of bores extending there through. Advantageously, the aerosol-forming article having an improved filter at its axial downstream end does not require a filter tow to prevent debris from entering a user's mouth. Moreover, the aerosol-forming article having an improved filter at its axial downstream end provides an improved airflow from an aerosol-forming substrate to the mouthpiece end. For instance, it is believed by drawing the airflow through the bores rather than through a tow filter, the draw resistance can be reduced providing an improved delivery to the user. Additionally, it has been found that by drawing the airflow through the bores rather than through a filter tow, an advantageous airflow can be created in the aerosol-forming article upstream of the filter segment, which can create a better mixing of the nicotine and vapor. Additionally, it is believed by drawing the airflow through the bores rather than through a tow filter, less vapor condenses in the filter, maximizing the delivery of the vapor and nicotine.

According to a first aspect, there is provided an aerosol-forming article (e.g., a smoking substitute article such as an HNB consumable) comprising a filter segment having a plurality of bores extending there through, wherein each bore of the plurality of bores are open to the exterior at a mouth-end of the aerosol-forming article. Advantageously, by being open to the mouth-end, the aerosol-forming article does not include a filter tow downstream of the filter segment. By providing the airflow of the aerosol through the plurality of bores, it has been found there is less condensation of the vapor in the filter element as compared to the airflow being drawn through a filter tow.

According to a different aspect, there is provided an aerosol-forming article (e.g., a smoking substitute article such as an HNB consumable) comprising a filter segment having a plurality of bores extending there through, wherein adjacent and upstream to the filter segment there is arranged a spacer element. Advantageously, the spacer element provides a cavity for mixing and cooling the vapor and causing the airflow to be drawn through the plurality of bores can cause a venture effect in the cavity to enhance the mixing of the vapor.

According to a different aspect, there is provided an aerosol-forming article (e.g., a smoking substitute article such as an HNB consumable) comprising a filter segment having a plurality of bores extending there through, wherein a total cross-sectional area of the plurality of bores is less than 20% of the cross-sectional area of the filter segment. Preferably, the total cross-sectional area of the plurality of bores is less than 15% or less than 10% or approximately 6% of the cross-sectional area of the filter segment. Advantageously, by controlling the porosity of the filter segment, the filter segment can be arranged to have a relatively low drag resistance as compared to that of a filter tow, whilst maintaining a good filter property such that an additional filter tow is not required.

According to a different aspect, there is provided an aerosol-forming article (e.g., a smoking substitute article such as an HNB consumable) comprising a filter segment having a plurality of bores extending there through, wherein a cooling segment is arranged upstream of the filter segment, the cooling segment comprising a portion having a central bore and a center of each of the plurality of bores is arranged radially outside of the central bore. Advantageously, by arranging the bore center's outside of the central bore, a tortuous airflow is created, which assists in the filtering of debris from the airflow.

Consequently, the filter segment allows delivery of an aerosol (through the plurality of bores) to the user's mouth that remains rich in volatile compound and visible vapor. The filter segment also provides a low resistance to draw (RTD) which provides a more comfortable smoking experience for the user. Furthermore, the filter segment can act as an airflow restrictor which contributes to a vapor mixing effect by increasing the local airflow speed within the plurality of bores.

In the exemplary embodiments, the filter segment has a body formed from a substantially solid/non-porous material. For instance, the filter segment body is formed from a material which, in use, is non-porous to the airflow such that the airflow takes the path of least resistance through the bores that extend through the body. The bores may be mechanically formed in the body, for instance, by being pressed or machined to remove material from the body. Alternatively, or additionally, the bores may be molded in the material when forming the body. For instance, the material may be cast about a former and when the material has set, the material is removed from the former to form a body having the bores there through.

Suitably, each bore of the plurality of bores is substantially the same. For instance, each bore may have a substantially identical cross-sectional profile.

In the exemplary embodiments, the filter segment comprises a plurality of bores extending there through. For instance, the filter segment comprises a body and the plurality of bores extend through the body from one surface to another. As will be appreciated, typically, the aerosol-forming article is generally cylindrical in form. Thus, the body of the filter segment has a generally cylindrical form. Here, the plurality of bores extend between opposed radial faces forming the distal ends of the cylindrical body. Preferably, the plurality of bores are distinct. That is, a first bore of the plurality of bores is not in fluid communication with a second bore of the plurality of bores. Thus, airflow in the first bore is retained in the first bore between distal ends of a body of the filter segment. In exemplary embodiments, each bore of the plurality of bores is substantially straight. Furthermore, in exemplary embodiments, one bore of the plurality of bores is substantially parallel to a second bore of the plurality of bores. Preferably, the filter segment has a longitudinal axis, for instance a central axis of a body having a cylindrical form. Here, suitably, the plurality of bores extend through the body, wherein each bore is substantially parallel to the longitudinal axis. In exemplary embodiments, each bore of the plurality of bores has a substantially constant cross-section. Whilst a number of cross-sectional shapes are envisaged, preferably, the cross-sectional shape is generally circular. It will be appreciated that bores having circular and non-circular cross-sectional shapes may alternately be described as channels or holes or passageways or apertures or other terms. Thus, the term bore may be interchanged with other terms defining a specific fluid pathway from one distal face to another distal face.

In exemplary embodiments, the plurality of bores extending through a body of the filter segment are open to an exterior of the mouthpiece end. Here, the plurality of bores extend through the body and terminate at a distal end of the body. For instance, as explained above, the plurality of bores may terminate at a distal, end face or distal radial face of the body forming the filter segment. Suitably, the end face is planar. That is, the face forms a substantially flat plane. The substantially flat plane of the end face may be arranged to extend perpendicularly to a generally longitudinal extent of the filter segment. In some embodiments, the plurality of bores extend parallel to the generally longitudinal extend and therefore, here, the substantially flat plane of the end face can be arranged to extend perpendicularly to the plurality of bores. In the exemplary embodiments wherein the plurality of bores are open to an exterior of the mouth piece end, the aerosol-forming article forms an airflow and the aerosol-forming article does not include a downstream element from the filter segment that restricts the airflow to a greater extent than the plurality bores of the filter segment. That is, if each bore of the plurality of bores were extended past the distal end of the filter segment's body, the aerosol-forming article does not include a feature that would block or restrict that extended bore. Preferably, a distal end of the filter segment's body coincides with the terminal distal mouthpiece end of the aerosol-forming article. That is, the plurality of bores terminate in the body at an end face having a plane wherein the plane corresponds to a plane defining the extent of the aerosol-forming article. Advantageously, the filter segment's body can be formed from a material having a strength to resist compression, for instance compression by a user's lips, such that the distal mouthpiece end of the aerosol-forming article provides resistance to being crushed in use. In the exemplary embodiments, the plurality of bores being open to an exterior of the mouthpiece end may be combined with other exemplary embodiments or in isolation, in which case there is provided an aerosol-forming device having a filter segment comprising a plurality of bores formed there through, wherein the plurality of bores are open to an exterior of the mouthpiece end of the aerosol-forming device.

It will be appreciated that in the exemplary embodiments wherein the plurality of bores are open to an exterior of the mouthpiece end, a filter tow is specifically excluded from being arranged downstream of the filter element in the aerosol-forming article. That is, if a filter tow was present, the bores would not be open to the end because the filter tow would restrict the virtual extended bores. In exemplary embodiments, the aerosol-forming article also does not include a filter tow upstream of the filter segment. That is, the filter segment having a plurality of bores extending there through is the greatest restriction to the airflow between the aerosol-forming substrate and the terminal distal mouthpiece end of the aerosol-forming article. For instance, the aerosol-forming article may comprise the filter segment and an aerosol-forming substrate. Here, the filter segment may abut the aerosol-forming substrate. However, preferably the filter segment is separated from the aerosol-forming substrate by a cooling segment. The cooling segment acts to cool and/or mix the vapor. Arranged upstream of the filter segment, it will be appreciated the cooling segment may be spaced longitudinally between the aerosol-forming substrate and filter segment. In the embodiment wherein the filter segment provides the greatest restriction to the airflow downstream from the aerosol-forming substrate, the cooling segment provides an airflow passage having a greater cross-sectional area or combined cross-sectional area than the combined cross-sectional area through the plurality bores of the filter segment. For instance, the aerosol-forming article may provide an airflow passage between the aerosol-forming substrate and the filter segment, wherein the air flow passage has a minimum cross-sectional area (or total cross-sectional area where the airflow passage is formed from a plurality of passages) at least 200% or at least 250% or at least 280% or at least 290% or at least 298% greater than the total cross-sectional area of the plurality of bores in the filter segment.

Suitably, the plurality of bores may be arranged around a notional circle. Here, the notional circle may be centered on an axis of a generally longitudinal extent of the filter segment. For instance, the filter segment is generally elongate having a central longitudinal axis and the notional circle is centered on the axis. As will be appreciated, typically the filter segment is cylindrical, in which case the notional circle is centered on the central axis of the cylinder. The plurality of bores may be equally spaced around the notional circle. The plurality of bores may consist of three bores. Alternatively, the plurality of bores may comprise three or more bores. In exemplary embodiments wherein the bores are arranged around a notional circle, the central longitudinal axis of each bore may be arranged on a notional circle. In a typically envisaged arrangement wherein the filter segment is generally cylindrical, the radius of the notional circle about which the central axes of the bores are arranged may be greater than 30% or greater than 40% or greater than 43% of the radius of the filter segment. Furthermore, in exemplary embodiments wherein each bore of the plurality of bores has a circular cross-section having a radius, the radius of the notional circle about which the central axes of the bores are arranged may be greater than 130% or greater than 140% or greater than 150% of the radius of a bore of the plurality of bores. It will be appreciated that when the bores are arranged about a notional circle, a central axially extending region of the filter segment is formed without the presence of a bore. That is, no part of a bore is formed in a central region of the upstream face of the filter segment. The central region may include a circular region. Here, suitably, the circular region has a center coincident with the central axis of the generally longitudinal extent of the filter segment. Preferably, the circular region may have a radius that is less than 43% or less than 35% or less than 30% of the radius of the filter segment. Additionally, or alternatively, the circular region may have a radius that is greater than 20% or greater than 25% of the radius of the filter segment. The exemplary embodiments comprising the plurality of bores arranged about a notional circle may be combined with other exemplary embodiments or may be used in isolation, in which case there is therefore provided an aerosol-forming device having a filter segment comprising a plurality of bores formed there through, wherein the plurality of bores are arranged about a notional circle.

Suitably, the plurality of bores may be arranged so that no part of a bore is formed in a central region of the upstream face of the filter segment. In embodiments wherein the aerosol-forming article includes elements located between the aerosol-forming substrate and the filter segment, the airflow may be most restricted by a part of said elements having a specific cross-section and here, the central region may include a region having the same cross-sectional shape wherein the area of the cross-sectional shape of the central region is around 8%-10% of the area of the cross section of said element. For instance, where the elements located between the aerosol-forming substrate and the filter segment comprise an element having a central passageway, the central region has an area around 8%-10% of the area of the central passageway. If the central passageway of said element has a circular cross-section, the central region may have a corresponding circular area. Here, the circular region may have a radius that is less than 43% or less than 35% or less than 30% of the radius of the filter segment. Additionally, or alternatively, the circular region may have a radius that is greater than 20% or greater than 25% of the radius of the filter segment. The exemplary embodiments wherein no part of the plurality of bores are arranged in a central region may be combined with other exemplary embodiments or may be used in isolation, in which case there is therefore provided an aerosol-forming device having a filter segment comprising a plurality of bores formed there through, wherein the plurality of bores are arranged so that the bores are not formed in a central region of the filter segment.

Suitably, each bore of the plurality of bores is substantially identical. Here, in exemplary embodiments, the bores are sized relative to the size of the filter segment. For instance, each bore has an internal cross-sectional area of preferably around 1.9%-2% of the total cross-sectional area of the filter segment. For instance, around 1.9%-2% of an area of an upstream distal end face of the filter segment. Suitably though, each bore may have an internal cross-sectional area of between 0.5% and 4.5% or between 1% and 3.3% or between 1.2% and 2.9% of the total cross-sectional area of the filter segment. Additionally, or alternatively, the bores have a maximum cross-sectional dimension of preferably around 14%-15% of the maximum dimension of the total cross-sectional area of the filter segment. For instance, around 14%-15% of a maximum dimension across an upstream distal end face of the filter segment. Suitably though, each bore may have a maximum dimension of between 7% and 21% or between 10% and 19% or between 11% and 16% of the maximum dimension of the filter segment. In exemplary embodiments, wherein the bores and/or the filter segment have a circular cross-section, the maximum dimension corresponds to a diameter. The exemplary embodiments comprising each of the plurality of bores being sized relative to the size of the filter segment may be combined with other exemplary embodiments or may be used in isolation, in which case there is therefore provided an aerosol-forming device having a filter segment comprising a plurality of bores formed there through, wherein the plurality of bores are arranged so that each bore has: an internal cross-sectional area of preferably around 1.9%-2% of the cross-sectional area of the filter segment; or a maximum cross-sectional dimension of preferably around 14%-15% of the maximum dimension of the filter segment.

In an exemplary embodiment, the filter segment having a plurality of bores there through is adapted to have a porosity of around 6%. Here, the porosity is a measure between the total cross-sectional area of the plurality of the bores relative to the total cross-sectional area of the filter segment. For instance, the porosity of the filter segment is a measure of the total cross-sectional area of the bores formed in an upstream end face of the filter segment relative to the area of the upstream end face. Suitably though, the total cross-sectional area of the bores is less than 20% or less than 15% or less than 10% of the cross-sectional area of the upstream end face of the filter segment. The filter segment having a specific porosity may be combined with any other features or exemplary embodiments, but in particular, the porosity may be achieved by controlling the number and/or the size of the plurality of bores. Alternatively, the porosity may be used in isolation, in which case there is therefore provided an aerosol-forming device having a filter segment comprising a plurality of bores formed there through, wherein the plurality of bores are arranged to have a porosity of around 6%.

As will be appreciated, the exemplary embodiments include an aerosol-forming substrate which is capable of being heated to release at least one volatile compound that can form an aerosol. The aerosol-forming substrate is typically located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia californica* (California Poppy), *Fittonia albivenis, Hippobroma longiflora, Humulus japonica* (Japanese Hops), *Humulus lupulus* (Hops), *Lactuca virosa* (Lettuce Opium), *Laggera alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incamata* (Passionflower), *Pedicularis densiflora* (Indian Warrior), *Pedicularis groenlandica* (Elephant's Head), *Salvia divinorum, Salvia dorrii* (Tobacco Sage), *Salvia* species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (Damiana), *Verbascum* (Mullein), *Zamia latifolia* (Maconha Brava) together with any combinations, functional equivalents to, and/or synthetic alternatives of the foregoing.

Preferably, the plant material is tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and *rustica* tobacco. This also includes blends of the above mentioned tobaccos.

Any suitable parts of the tobacco plant may be used. This includes leaves, stems, roots, bark, seeds and flowers.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

In some embodiments, the sheet used to form the aerosol-forming substrate has a grammage greater than or equal to 100 $g/m^2$, e.g., greater than or equal to 110 $g/m^2$ such as greater than or equal to 120 $g/m^2$.

The sheet may have a grammage of less than or equal to 300 $g/m^2$, e.g., less than or equal to 250 $g/m^2$ or less than or equal to 200 $g/m^2$.

The sheet may have a grammage of between 120 and 190 $g/m^2$.

The aerosol-forming substrate may comprise at least 50 wt % plant material, e.g., at least 60 wt % plant material, e.g., around 65 wt % plant material. The aerosol-forming substrate may comprise 80 wt % or less plant material, e.g., 75 or 70 wt % or less plant material.

The aerosol-forming substrate may comprise one or more additives selected from humectants, flavorants, fillers, aqueous/non-aqueous solvents and binders.

Humectants are provided as vapor generators—the resulting vapor helps carry the volatile active compounds and increases visible vapor. Suitable humectants include polyhydric alcohols (e.g., propylene glycol (PG), triethylene glycol, 1,2-butane diol and vegetable glycerin (VG)) and their esters (e.g., glycerol mono-, di- or tri-acetate). They may be present in the aerosol-forming substrate in an amount between 1 and 50 wt %.

The humectant content of the aerosol-forming substrate may have a lower limit of at least 1% by weight of the plant material, such as at least 2 wt %, such as at least 5 wt %, such as at least 10 wt %, such as at least 20 wt %, such as at least 30 wt %, or such as least 40 wt %.

The humectant content of the aerosol-forming substrate may have an upper limit of at most 50% by weight of the plant material, such as at most 40 wt %, such as at most 30 wt %, or such as at most 20 wt %.

Preferably, the humectant content is 1 to 40 wt % of the aerosol-forming substrate, such as 1 to 20 wt %

Suitable binders are known in the art and may act to bind together the components forming the aerosol-forming substrate. Binders may comprise starches and/or cellulosic binders such as methyl cellulose, ethyl cellulose, hydroxypropyl cellulose, hydroxyethyl cellulose and methyl cellulose, gums such as xanthan, guar, arabic and/or locust bean gum, organic acids and their salts such as alginic acid/sodium alginate, agar and pectins.

Preferably the binder content is 5 to 10 wt % of the aerosol-forming substrate, e.g., around 6 to 8 wt %.

Suitable fillers are known in the art and may act to strengthen the aerosol-forming substrate. Fillers may comprise fibrous (non-tobacco) fillers such as cellulose fibers, lignocellulose fibers (e.g., wood fibers), jute fibers and combinations thereof.

Preferably, the filler content is 5 to 10 wt % of the aerosol-forming substrate, e.g., around 6 to 9 wt %.

The aerosol-forming substrate may comprise an aqueous and/or non-aqueous solvent. In some embodiments, the aerosol forming substrate has a water content of between 5 and 10 wt %, e.g., between 6-9 wt % such as between 7-9 wt %.

The flavorant may be provided in solid or liquid form. It may include menthol, licorice, chocolate, fruit flavor (including, e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be circumscribed by a wrapping layer, e.g., a paper wrapping layer. The wrapping layer may overlie an inner foil layer or may comprise a paper/foil laminate (with the foil innermost).

The aerosol-forming substrate may be formed in a substantially cylindrical shape such that the article/consumable resembles a conventional cigarette. It may have a diameter of between 5 and 10 mm, e.g., between 6 and 9 mm or 6 and 8 mm, e.g., around 7 mm. It may have an axial length of between 10 and 15 mm, e.g., between 11 and 14 mm such as around 12 or 13 mm.

According to one exemplary embodiment, the filter segment is arranged immediately downstream of the aerosol-forming substrate. For instance, the filter segment abuts directly against the aerosol-forming substrate. However, it is preferable that the aerosol-forming substrate and the filter segment are separated by a cooling segment. Suitably, the cooling segment abuts between the downstream distal end of the aerosol-forming substrate and the upstream distal end of the filter segment. In exemplary embodiments, the cooling segment forms an airflow passage between the aerosol-forming substrate and the filter segment. Here, suitably, the airflow passage is formed as a central bore. Consequently, according to another exemplary embodiment, there is provided an aerosol-forming device having a filter segment comprising a plurality of bores formed there through, wherein a cooling segment is arranged upstream of the filter segment and the cooling segment comprises a central bore. In exemplary embodiments including the cooling segment having a central bore, the minimum cross-sectional area of the cooling segment may correspond to a central area along the axis of a generally longitudinal extent of the aerosol-forming device and the central axis of each of the plurality of bores is arranged to be radially outside the central area. Advantageously, it is believed that by arranging the centers of each bore outside the central area corresponding to the minimum cross-sectional area of the cooling segment, the airflow is caused or encouraged to take a tortuous path through the aerosol-forming device which improves the mixing or other characteristics of the vapor. As will be appreciated, when forming the centers of the plurality of bores radially outside the central area, the bores may also be arranged about a notional circle and/or to have a porosity of around 6% and/or to have a relative size and/or to have a central region with no bores. That is the bores being arranged radially outside the central area may be combined with other embodiments individually or combined.

In exemplary embodiments including a cooling segment, the cooling segment may comprise a first portion and a second portion. Suitably, the first portion is formed upstream relative to the second, downstream portion. However, the first and second portions may be alternately arranged. Suitably, one of the portions, and in the exemplary embodiments, the first portion, comprises a portion having a central bore. The central bore provides an air flow path through the first portion. The central bore is therefore suitably formed to be elongate along a central axis of the portion. Moreover, preferably the central bore has a constant cross-sectional area. Typically, as will be appreciated, the portion has a generally cylindrical form. Moreover, the central bore may suitably have a circular cross section. Preferably, the cross-sectional area of the central bore of the portion may be around 17%-18% of the cross-sectional area of the portion. However, suitably, the cross-sectional area of the central bore of the portion may be between 15% and 20% of the cross-sectional area of the portion. For instance, the portion, herein the first portion, may be termed a hollow bore filter (HBF). Where the portion is cylindrical and the central bore is also cylindrical, for instance, preferably a co-axial cylinder, the diameter of the central bore may be between 40% and 45% and preferably around 42%-43% of the diameter of the portion.

In the exemplary embodiments including a cooling segment having a first portion and a second portion, suitably the other of the portions, and in the exemplary embodiments, the second portion, also comprises a portion having a central bore. The central bore provides an air flow path through the first portion. The central bore is therefore suitably formed to be elongate along a central axis of the portion. Moreover, the central bore may suitably have a constant cross-sectional area. Typically, as will be appreciated, the portion has a generally cylindrical form. Moreover, the central bore may suitably have a circular cross section. Preferably, the cross-sectional area of the central bore of the portion may be greater than 95% or greater than 97% of the cross-sectional area of the portion. For instance, the portion, herein the second portion, may be a spacer or spacer tube. For instance, a spacer formed from a cardboard tube or the like. Preferably, the diameter of the internal bore may be at least 95% or at least 98% of the diameter of the portion.

Where present, the cooling segment having a first portion (i.e., the HBF) may act to cool the vapor prior to user inhalation thus increasing comfort for the user. Where present, the cooling segment having a second portion (i.e., the spacer tube) may act to cool and mix the vapor generated from the aerosol-forming substrate. Here, the central bore of the spacer is larger than the central bore of the HBF. Moreover, suitably, the HBF and spacer element are arranged consecutively between the aerosol-forming substrate and the filter element. Preferably, the spacer tube having the larger central bore is arranged downstream of the HBF.

At least a portion of the cooling segment and a portion of the aerosol-forming substrate may be circumscribed with a plug wrap, e.g., a paper plug wrap. Where the cooling segment comprises multiple portions, at least a part of each portion may be circumscribed with the plug wrap. Whilst an element may be said to be at least partially circumscribed, it will be appreciated that typically the elements are totally or entirely or completely circumscribed.

In exemplary embodiments including a spacer tube, the central bore size may suitably be restricted relative to the filter segment. Thus, the spacer tube can abut a distal face of the filter segment when arranged in longitudinal alignment. Similarly, the central bore size of the spacer tube may suitably be restricted relative to the adjacent upstream element (e.g., the aerosol-forming substrate or the HBF). Thus, the spacer tube can abut a distal face of the upstream element. Advantageously, the spacer tube therefore provides an abutment to space the filter segment from the upstream element. Here, suitably, at least a portion of the spacer tube and a portion of the filter segment are circumscribed with a plug wrap. As will be appreciated, the respective elements may be circumscribed by a single plug wrap or by a plurality of separate plug warps. For instance, one plug wrap may circumscribe the portion of the spacer and upstream element and a second plug wrap may circumscribe a portion of the spacer and the filter segment. Here one of the plug warps may also circumscribe the other plug wrap.

The cooling segment is adapted to cool the aerosol generated from the aerosol-forming substrate (by heat exchange) before being inhaled by the user. The cooling segment may be axially adjacent the filter segment. Furthermore, the first portion of the cooling segment comprising the HBF and/or the filter segment may be formed of a plastics material selected from the group consisting of polylactic acid (PLA), polyvinyl chloride (PVC), polyethylene (PE) and polyethylene terephthalate (PET). The aerosol-cooling element may be formed of a crimped/gathered sheet of material to form a structure having a high surface area with a plurality of longitudinal channels to maximize heat exchange and cooling of the aerosol. The spacer suitably defines a space or cavity or chamber, for example, a space or cavity between the first portion (e.g., HBF) and the filter segment. The spacer acts to allow both cooling and mixing of the aerosol. The spacer element may be axially adjacent the filter segment. The spacer may be axially adjacent the upstream element (e.g., HBF). The spacer element may be a tubular element, e.g., a cardboard tube.

The exemplary embodiments comprising a cooling segment including a spacer tube may be combined with other exemplary embodiments singularly or in combination or the spacer tube providing an improved assembly and/or an improved mixing of the vapor when used in combination with the filter segment may be beneficial in isolation, in which case there is therefore provided an aerosol-forming device having a filter segment comprising a plurality of bores formed there through, wherein the filter segment is arranged in abutment with and downstream to a spacer tube.

In a second aspect, there is provided a smoking substitute system comprising an aerosol-forming device according to the first aspect and a device comprising a heating element.

The device may be a HNB device, i.e., a device adapted to heat but not combust the aerosol-forming substrate. Here, the device may comprise a main body for housing the heating element. The heating element may comprise an elongated, e.g., rod, tube-shaped or blade heating element. The heating element may project into or surround a cavity within the main body for receiving the article/consumable described above. The device (e.g., the main body) may further comprise an electrical power supply, e.g., a (rechargeable) battery for powering the heating element. It may further comprise a control unit to control the supply of power to the heating element.

In a third aspect, there is provided a method of using a smoking substitute system according to the second aspect, the method comprising: inserting the article/consumable into the device; and heating the article/consumable using the heating element. In some embodiments, the method comprises inserting the article/consumable into a cavity within the main body and penetrating the article/consumable with the heating element upon insertion of the article/consumable. For example, the heating element may penetrate the aerosol-forming substrate in the article/consumable.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein either singly or in combination.

SUMMARY OF THE FIGURES

So that the disclosure may be understood, and so that further aspects and features thereof may be appreciated, embodiments illustrating the principles of the disclosure will now be discussed in further detail with reference to the accompanying figures, in which.

DETAILED DESCRIPTION OF THE FIGURES

Figure 1:
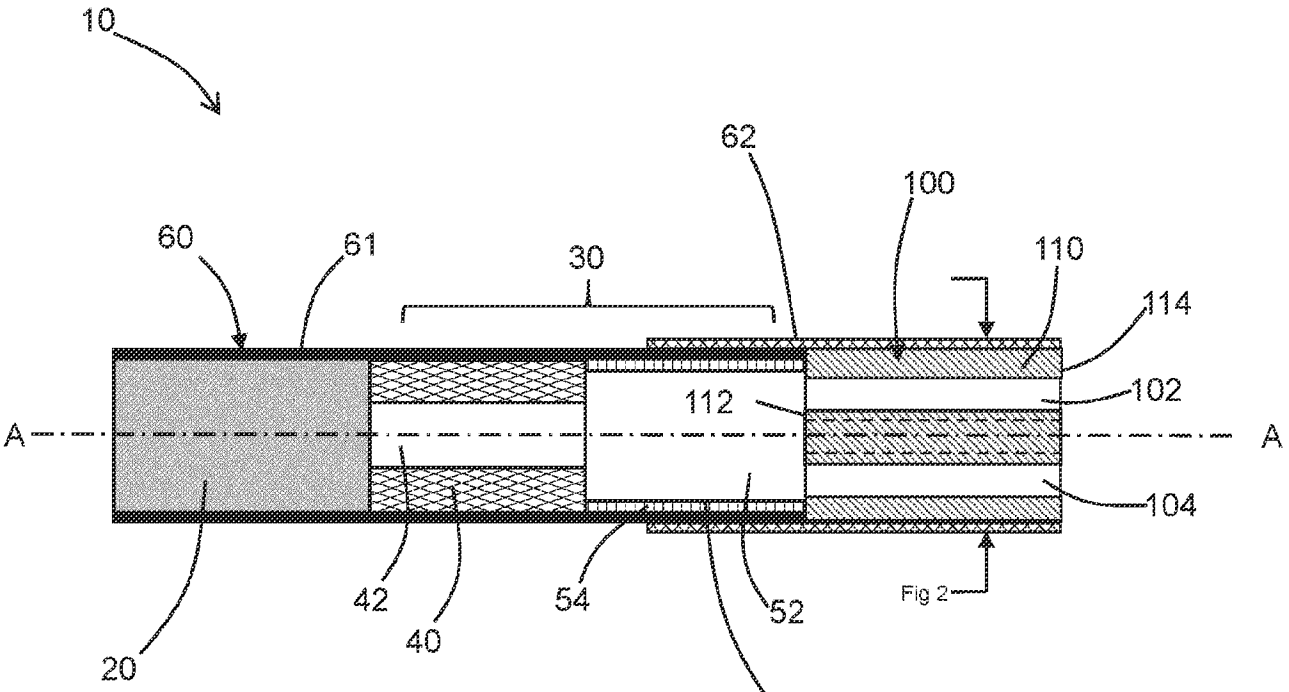
FIG. 1 shows a schematic cross-sectional view of an aerosol-forming article.

Referring to FIG. 1, an aerosol-forming article 10 is generally shown having an aerosol-forming substrate 20 at one distal end and a filter segment 100 at an opposed distal. Suitably, the aerosol-forming article 10 is shown as having a cooling segment 30 disposed between the aerosol-forming substrate 20 and the filter segment 100. Here, the aerosol-forming substrate 20 is arranged at an upstream end of the cooling segment 30 and the filter segment is arranged at a downstream end thereof. As used herein, the terms "upstream" and "downstream" are intended to refer to the flow direction of the vapor/aerosol, i.e., with the downstream end of the article/consumable being the mouth end or outlet where the aerosol exits the article/consumable for inhalation by the user. The upstream end of the article/consumable is the opposing end to the downstream end.

As shown in FIG. 1, the aerosol-forming article 10 is suitably a Heat Not Burn (HNB) consumable comprising the aerosol-forming substrate 20 at the upstream end of the consumable 10. The aerosol-forming substrate comprises reconstituted tobacco which includes nicotine as a volatile compound.

The aerosol-forming substrate 20 comprises 65 wt % tobacco which is provided in the form of gathered shreds produced from a sheet of slurry/paper recon tobacco. The tobacco is dosed with 20 wt % of a humectant. Here, propylene glycol (PG) or vegetable glycerin (VG) are suitable humectants, either used individually or mixed together or with other materials. Ideally, the aerosol-forming substrate has a moisture content of between 7-9 wt %, but the moisture content may be wider than this range. The aerosol-forming substrate further comprises cellulose pulp filler and guar gum binder.

The aerosol-forming substrate 20 is formed in a substantially cylindrical shape such that the consumable resembles a conventional cigarette. Here, the cylindrical shape has a generally longitudinal extend having a central axis A. Moreover, the aerosol-forming substrate has a generally circular cross-sectional shape of generally uniform and consistent shape along the length of the substrate. Suitably, the aerosol-forming substrate has diameter of around 7 mm and an axial length of around 12 mm. That is, the aerosol-forming substrate 20 has a length around 170%-175% greater than its diameter.

The aerosol-forming article 10 is circumscribed by a paper wrapping as is generally known in the art. In FIG. 1, the paper wrapping is indicated generally by reference 60. Here, the paper wrapping may comprise a single paper wrapping layer, however, a plurality of paper wrapping layers 61, 62 are shown in FIG. 1. In addition, the aerosol-forming substrate is circumscribed by a separate paper wrapping layer (not shown) so as to form a wrapped tobacco rod. The wrapped tobacco rod is wrapped again with paper wrapping layer 61 to assemble the aerosol-forming article 10.

The aerosol-forming article 10 comprises a cooling segment 30. As shown, the cooling segment 30 comprises a first portion 40 and a second portion 50. The first portion 40 is shown as an upstream portion and, as will be described, can be termed a Hollow Bore Filter (HBF) element. The second portion 50 is shown as a downstream portion and, as will be described, can be termed a spacer element. As shown, both portions have central bores, wherein, when aligned as a cooling segment 30 as a single unit, the central bores are coaxial. Here, the combined central bore of the cooling element includes a step wherein the central bore increase in size in a downstream direction. Suitably, the spacer element 50 is a cardboard spacer tube or the like. The HBF element 40 and spacer element 50 are circumscribed by the wrapping layer 61. Thus, the parts have a substantially equal outer diameter. As shown, the wrapping layer 61 is a single wrapping layer 60 that wraps at least a portion of each of the aerosol-forming substrate, the first portion 40 and the second portion 50. Thus, the exterior diameter of the aerosol-forming substrate 20 is substantially the same as the exterior diameter of the cooling segment 30. As shown, the wrapping layer circumscribes substantially the entire length of each element. As will be understood, the wrapping layer 61 is used to maintain the elements in a single unit, wherein the elements have been aligned and abutted against each other to form a generally cylindrical unit. Here, the generally cylindrical unit has a central axis A. As will be understood, the cooling segment 30 therefore forms a generally cylindrical unit having a circular cross-section of generally uniform and consistent exterior shape along the length of the cooling segment 30.

The first portion 40 of the cooling element has a central bore 42. The central bore 42 is also generally cylindrical in shape and therefore has a generally circular cross-sectional shape having a constant and consistent size along the length of the first portion 40. The axial length of the first portion 40 is suitably around 10 mm and the diameter around 7 mm. Thus, the first portion 40 has a length around 140%-150% of the diameter. The central bore 42 suitably has a diameter around 3 mm. Thus, the diameter of the central bore 42 has a diameter of around 42%-43% of the diameter of the first portions exterior surface. Suitably though the diameter of the central bore 42 may be between 40% and 45% of the diameter of the first portions exterior surface. That is, the diameter of the central bore 42 may be between around 2.8 mm to 3.2 mm. Moreover, for non-circular bores and exterior shapes, the relationship between the bore size and overall size may be expressed in relation to area, wherein the cross-sectional area of the central bore 42 may be around 17%-18% and between 15% and 20% of the cross-sectional area of the first portion. As will be appreciated, the size of the first element 40 having a central bore 42 with an appropriate relative size provides an element that might also be referred to as a HBF element.

The second portion 50 of the cooling element has a central bore 52. The central bore 52 is also generally cylindrical in shape and therefore has a generally circular cross-sectional shape having a constant and consistent size along the length of the second portion 50. The axial length of the second portion 50 is suitably around 10 mm and the diameter around 7 mm. Thus, the second portion 50 has a length around 140%-150% of the diameter. Moreover, the first portion 40 and the second portion 50 are generally similar in external size. However, the second portion 50 has an enlarged central bore size as compared to the first portion 40. For instance, the second portion 50 is shown as a thin-walled tube. Here, a wall 54 of the second portion 50 may have a wall thickness of around 0.04 mm. Thus, the central bore 52 of the second portion 50 has a diameter around 99% of the diameter of the exterior surface of the second portion 50. As will be appreciated, the size of the second portion 50 having a central bore 52 with an appropriate relative size provides an element that might also be referred to as a spacer element. Specifically, the filter element 100 may be formed by a cardboard tube or the like.

As will be appreciated, the elements of the aerosol-forming article 10, that is the aerosol-forming substrate 20, the cooling element 30 (including the first portion 40 and the second portion 50) and the filter element 100, form an article having a generally cylindrical form where the elements each have a central axis that are assembled to be coincident along axis A. Moreover, during assembly, the elements can be abutted against each other to maintain an axial spacing. Specifically, the spacer element 50 can abut between the filter segment 100 and the upstream element (for instance, the first portion), wherein the spacer element 50 abuts distal faces of the respective parts.

The filter element 100 includes a plurality of bores 102, 104, 106 that extend through a body 110 of the filter element 100. The body 110 is formed in a substantially cylindrical shape such that the consumable 10 resembles a conventional cigarette. Here, the cylindrical shape has a generally longitudinal extend having a central axis A. Moreover, the filter segment 100 has a generally circular external cross-sectional shape of generally uniform and consistent shape along the length of the filter segment 100. Suitably, the filter segment 100 has diameter of around 7 mm and an axial length of around 12 mm. That is, the filter element 100 has a length around 170%-175% of its diameter. As explained, the external diameter of the cooling element 30 matches the external diameter of the aerosol-forming substrate 20. The external diameter of the filter segment 100 is slightly larger and matches the combined diameter of the aerosol-forming substrate 20 and the wrapping layer 60. The filter segment 100 is joined to the upstream elements forming the consumable by a circumscribing paper tipping layer 62. The tipping layer 62 encircles the filter element 100 and has an axial length of around 20 mm such that it overlays a portion of the cooling segment 30. As shown, the paper tipping layer 62 may be separate to the wrapping paper 60 and therefore one of the wrapping papers also circumscribes the other.

The body 110 of the filter segment 100 has opposing distal end faces. Since the filter segment 100 is generally cylindrical, the distal end faces are radial end faces. Here, the radial end faces are longitudinally opposed along a central axis. As shown, the body has an upstream distal face 112 and a downstream distal face 114. The bores extend between the distal faces 112, 114 and provide discrete airflow passages there between through which the aerosol is drawn from the central bore 52 of the spacer element 50 for delivery to a user's mouth at the downstream distal face 114 of the aerosol-forming article 10. As shown, the plurality of bores 102, 104, 106 are substantially identical. Moreover, they are arranged parallel to each other and to extend parallel to the central axis A. Preferably, as shown in FIG. 1, each bore 102, 104, 106 has a generally uniform and consistent circular cross-section along the length of the filter segment 100.

Figure 2A:
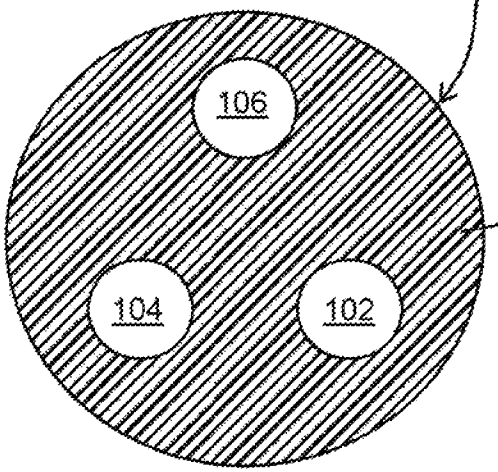
FIGS. 2A, 2B and 2C show schematic cross-sectional views through a filter segment of the aerosol-forming article of FIG. 1 with additional virtual markings for explanation.

Referring to FIG. 2A, the arrangement of the plurality of bores 102, 104, 106 is explained. The plurality of bores may comprise more than two or more than three bores, but according to the exemplary embodiment shown in FIG. 3, the plurality of bores consists of three bores 102, 104, 106. As will be appreciated, where other number of bores are adopted, the description of the bores herein is equally applicable.

Referring to one bore 102, the bore 102 has a circular cross-sectional area having a diameter of around 1 mm. However, it is envisaged that a bore diameter of between 0.5 mm and 1.5 mm or between 0.7 mm to 1.3 mm, or between 0.8 mm and 1.2 mm would be applicable. That is, the diameter of the bore 102, is suitably between 7% and 21% or between 10% and 19% or between 11% and 16% of the external diameter of the filter segment 100, but preferably between around 14-15% of the external diameter of the filter segment 100. Moreover, the cross-sectional area of the bore is therefore between 0.5% and 4.5% or between 1% and 3.3% or between 1.2% and 2.9% or preferably around 1.9% to 2% of the cross-sectional area of the filter segment 100.

The number and size of the plurality of bores 102, 104, 106 is suitably controlled to provide a filter element 100 having a porosity of around 6%. Here, the porosity is a calculation of the total cross-sectional area of the plurality of bores 102, 104, 106 relative to the total cross-sectional area of the filter segment 100. As shown, each bore has a cross-sectional area of around 0.79 mm^2. Having three bores, the total cross-sectional area of the plurality of bores 102, 104, 106 is around 2.36 mm^2. Thus, as shown the porosity is around 6%. However, it is envisaged, the porosity could be selected so that the total cross-sectional area of the plurality of bores is less than 20% or less than 15% or less than 10% of the cross-sectional area of the filter segment 100, which has an area of 39.81 mm2. It is thought that by selecting the porosity of the filter element beneath the limit finds a balance between low drag resistance and the provision of a good filter. For instance, with higher porosities that would further reduce the drag resistance of the filter element 100 it is likely that debris would not be adequately filtered. Thus, an additional filter tow would be needed and it is believed the drag resistance of the disclosed filter element would be lower than a combination of a filter tow and a filter element having a higher porosity.

Figure 2B:
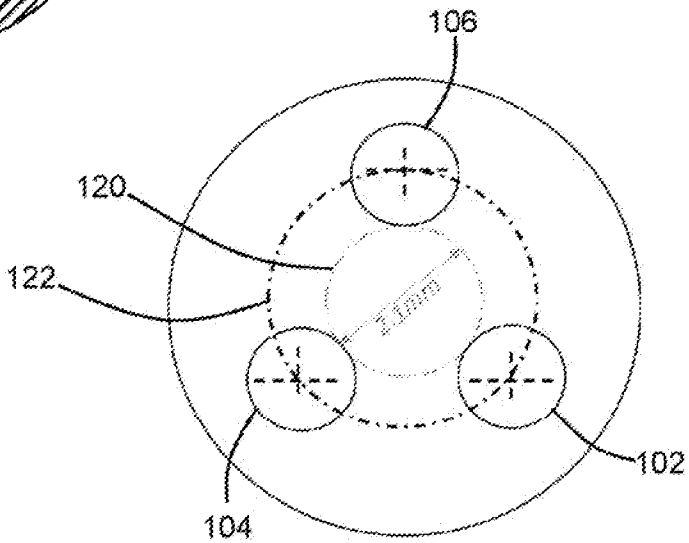

As shown in FIG. 2B, the plurality of bores 102, 104, 106 are spaced around a notional circle 120. Here, the centers of each bore 102, 104, 106 are arranged on a notional circle 122 centered on the central axis A of the filter segment 100. Suitably, the notional circle 122 has a radius or around 1.55 mm. However, it is envisaged that the radius of the notional circle upon which the bore centers are arranged is between 30% and 60% or between 40% and 50% and preferably around 42%-44% of the radius of the external surface of the filter segment 100. As shown, the plurality of bores 102, 104, 106 are equally spaced around the notional circle 122. That is, the angle subtended between each adjacent bore 102, 104, 106 is equal.

Although the bores 102, 104, 106 being arranged around a notional circle 122 is particularly suitable, it is envisaged that other arrangements may be applicable. Advantageously however, and as shown in FIG. 2*a*, the plurality of bores 102, 104, 106 are arranged to provide a central region wherein no bores are formed. For instance, the central region is shown bounded by circle 120. No bore is provided within the central, circular region 120. Suitably, the circle 120 has a diameter of around 2.1 mm. However, it is envisaged that a central area bounded by a circle having a radius of between 43% and 20% of the external radius of the filter element 100, could generate an advantageous tortuous airflow path.

Figure 2C:
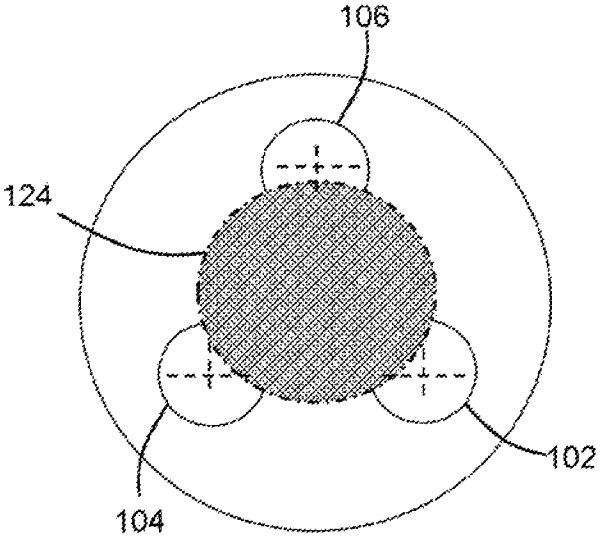

In particular, as shown in FIG. 2C, the tortuous path generated by the airflow is thought to be created, at least in part, by the centers of the plurality of bores 102, 104, 106 being arranged outside a central region that corresponds to the maximum restriction (e.g., the narrowest portion of the airflow path) in the cooling segment 30. For instance, as shown, the minimum restriction in the cooling segment 30 is provided by the central bore 42 of the HBF element 40. In FIG. 2*c* the central bore of the HBF element is shown as circle 124. Here, each bore 102, 104, 106 is arranged so that the center of the bore is arranged radially outside of the central region. The circle 124 (and therefore the central bore 42) typically has a radius of around 1.5 mm.

The plurality of bores 102, 104, 106 in the filter segment 100 are suitably open to the mouth end of the aerosol-forming article 10. As shown in FIG. 1, here, the filter segment 100 is a terminal filter segment, wherein the distal end 114 forms a distal end of the article 10. Or in other words, the distal end 114 forms a plane and the aerosol-forming article 10 does not extend downstream from the plane. However, in the event that an element of the aerosol-forming article 10 extends downstream from the distal end of the filter segment 100, the plurality of bores 102, 104, 106 would remain open to a mouth end if the bores 102, 104, 106 can virtually extend unimpeded to the distal end of the aerosol-forming article 10.

Figure 3:
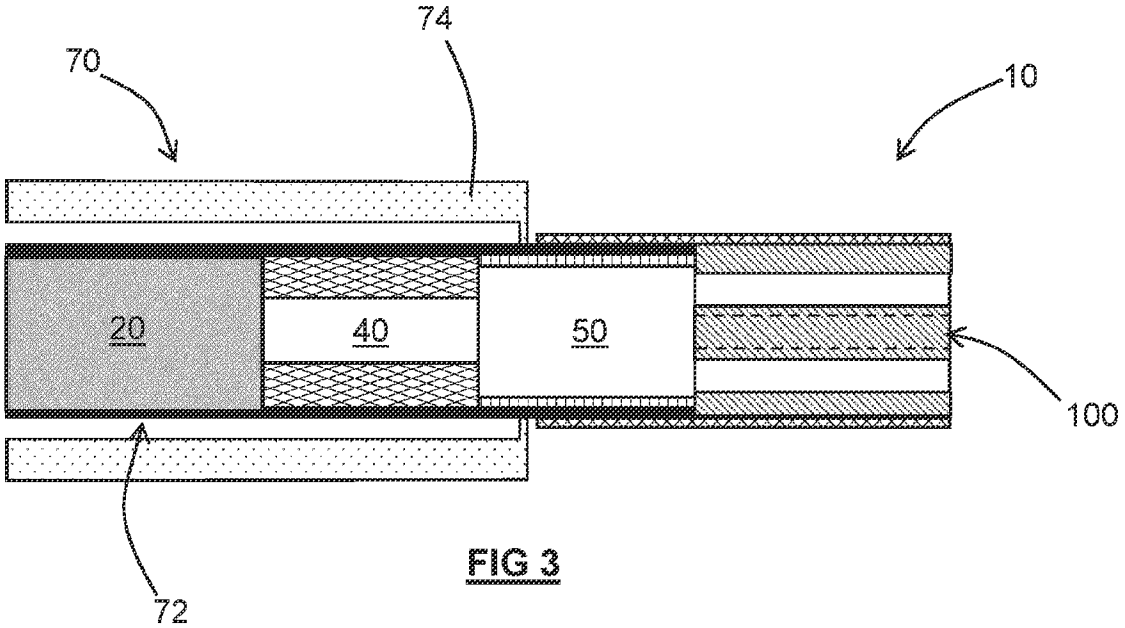
FIG. 3 shows a schematic cross-sectional view through a smoking substitute system wherein the aerosol-forming article of FIG. 1 is inserted into a heating device.

FIG. 3 shows the aerosol-forming article 10 inserted into a device 70. Suitably, the device 70 is a HNB device comprising a rod-shaped heating element (not shown). The heating element projects into a cavity 72 within a main body 74 of the device 10.

The consumable 10 is inserted into the cavity 72 of the main body 74 of the device 70 such that the heating rod penetrates the aerosol-forming substrate 20. Heating of the reconstituted tobacco in the aerosol-forming substrate 20 is effected by powering the heating element (e.g., with a rechargeable battery (not shown)). As the tobacco is heated, moisture and volatile compound (e.g., nicotine) within the tobacco and the humectant are released as a vapor and entrained within an airflow generated by inhalation by the user at the filter element 100.

The airflow is drawn through the aerosol-forming article as is known in the art. For example, from the aerosol-forming substrate 20, the airflow follows a path through the central bore of the HBF portion 40 of the cooling segment 30 and then through the central bore of the spacer segment 50. As the vapor cools within the HBF segment 40 and the cardboard spacer element 50, it condenses to form an aerosol containing the volatile compounds for inhalation by the user. The airflow continues and is drawn through the filter segment 100 and specifically the plurality of bores 102, 104, 106 that extend through the filter segment 100. It is believed that the arrangement of the plurality of bores 102, 104, 106 through the filter segment 100 produces an improved delivery of the aerosol to the user. For instance, as the airflow is caused to expand from the HBF segment 40 to the spacer element 50 and then through the plurality of bores 102, 104, 106, an advantageous airflow is generated to create an improved mixing of the airflow. The arrangement of the plurality of bores 102, 104, 106 may create a Venturi effect in the spacer element 50 as the user inhales to generate the airflow through the article 10, wherein the Venturi effect in the airflow helps mix the nicotine and vapor to create a smooth experience. Moreover, the filter element 100 has been found to provide good filtering of the airflow whilst providing a lower drag resistance as compared to a filter tow. It is believed the combination of high filtering and low drag resistance may be achieved by creating a tortuous airflow path from the aerosol-forming substrate 20 to downstream end of the filter segment 100.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

ILLUSTRATIVE EMBODIMENTS

The following numbered clauses, describing aspects of our proposals, are part of the description:

A1. An aerosol-forming article comprising a filter segment having a plurality of bores extending there through, wherein each bore of the plurality of bores are open to the exterior at a mouth-end of the aerosol-forming article.

A2. The aerosol-forming article of clause A1, wherein the filter segment comprises a body and the plurality of bores extend from one distal face of the body to an opposed distal face of the body.

A3. The aerosol-forming article of clause A2, wherein the distal face arranged at a downstream end of the filter segment coincides with a distal end of the aerosol-forming article.

A4. The aerosol-forming article of any of clause A1 to clause A3, wherein the filter segment has a generally elongate form having a central axis and each bore of the plurality of bores extends parallel to the central axis.

A5. The aerosol-forming article of any of clause A1 to clause A4, wherein each bore of the plurality of bores has a circular cross-section that is constant along the length of the filter segment.

A6. The aerosol-forming article of any of clause A1 to clause A5 including a cooling segment disposed upstream of the filter segment.

A7. The aerosol-forming article of clause A6 wherein at least a portion of the cooling segment includes a central bore.

A8. The aerosol-forming article of clause A7, wherein a diameter of the central bore is between 40% and 45% of a diameter of an external surface of said portion.

A9. The aerosol-forming article of clause A7 or clause A8, wherein the cooling segment includes at least a portion having a central bore with a cross-sectional area that forms a central region extending around the central axis and each of the plurality of bores has a center that is arranged radially outside of the central region.

A10. The aerosol-forming article of any of clause A7 to clause A9, wherein the cooling segment includes at least a portion having a central bore with a diameter greater than 95% of the diameter of an external surface of said portion.

A11. The aerosol-forming article of any of clauses A1 to A10, wherein a total cross-sectional area of the plurality of bores is less than 20% of the cross-sectional area of the filter segment.

A12. A system comprising a smoking substitute article according to any one of clauses A1 to A11 and a device comprising a heating element.

A13. The system according to clause A12 wherein the device comprises a main body for housing the heating element and the heating element comprises an elongated heating element.

A14. A method of using the system according to clause A12 or A13, the method comprising:

inserting the article into the device; and heating the article using the heating element.

A15. A method according to clause A14 comprising inserting the article into a cavity within a main body of the device and penetrating the article with the heating element upon insertion of the article.

B1. An aerosol-forming article comprising a filter segment having a plurality of bores extending there through, wherein adjacent and upstream to the filter segment there is arranged a spacer element.

B2. The aerosol-forming article of clause B1, wherein each bore of the plurality of bores are open to the exterior at a mouth-end of the aerosol-forming article.

B3. The aerosol-forming article of clause B2, wherein the filter segment comprises a body and the plurality of bores extend from one distal face of the body to an opposed distal face of the body.

B4. The aerosol-forming article of any of clause B1 to clause B3, wherein the distal face arranged at a downstream end of the filter segment coincides with a distal end of the aerosol-forming article.

B5. The aerosol-forming article of any of clause B1 to clause B4, wherein the filter segment has a generally elongate form having a central axis and each bore of the plurality of bores extends parallel to the central axis.

B6. The aerosol-forming article of any of clause B1 to clause B5, wherein each bore of the plurality of bores has a circular cross-section that is constant along the length of the filter segment.

B7. The aerosol-forming article of any of clause B1 to clause B6 including a cooling segment disposed upstream of the filter segment, wherein at least a portion of the cooling segment comprises the spacer element.

B8. The aerosol-forming article of clause B7, wherein a first portion of the cooling segment has a central bore with a diameter between 40% and 45% of a diameter of an external surface of the cooling segment and a second portion of the cooling segment is the spacer element having a central bore.

B9. The aerosol-forming article of clause B8, wherein the first portion has a central bore with a cross-sectional area that forms a central region extending around the central axis and each of the plurality of bores has a center that is arranged radially outside of the central region.

B10. The aerosol-forming article of any of clause B1 to clause B9, wherein the spacer element has a central bore with a diameter greater than 95% of the diameter of an external surface of said portion comprising the spacer element.

B11. The aerosol-forming article of any of clauses B1 to B10, wherein a total cross-sectional area of the plurality of bores is less than 20% of the cross-sectional area of the filter segment.

B12. A system comprising a smoking substitute article according to any one of clauses B1 to B11 and a device comprising a heating element.

B13. The system according to clause B12 wherein the device comprises a main body for housing the heating element and the heating element comprises an elongated heating element.

B14. A method of using the system according to clause B12 or B13, the method comprising:

inserting the article into the device; and heating the article using the heating element.

B15. A method according to clause B14 comprising inserting the article into a cavity within a main body of the device and penetrating the article with the heating element upon insertion of the article.

C1. An aerosol-forming article comprising a filter segment having a plurality of bores extending there through, wherein a total cross-sectional area of the plurality of bores is less than 20% of the cross-sectional area of the filter segment.

C2. The aerosol-forming article of clause C1, wherein each bore of the plurality of bores are open to the exterior at a mouth-end of the aerosol-forming article.

C3. The aerosol-forming article of clause C2, wherein the filter segment comprises a body and the plurality of bores extend from one distal face of the body to an opposed distal face of the body.

C4. The aerosol-forming article of any of clause C1 to clause C3, wherein the distal face arranged at a downstream end of the filter segment coincides with a distal end of the aerosol-forming article.

C5. The aerosol-forming article of any of clause C1 to clause C4, wherein the filter segment has a generally elongate form having a central axis and each bore of the plurality of bores extends parallel to the central axis.

C6. The aerosol-forming article of any of clause C1 to clause C5, wherein each bore of the plurality of bores has a circular cross-section that is constant along the length of the filter segment.

C7. The aerosol-forming article of any of clause C1 to clause 6 including a cooling segment disposed upstream of the filter segment.

C8. The aerosol-forming article of clause C7, wherein at least a portion of the cooling segment has a central bore with a diameter between 40% and 45% of a diameter of an external surface of said portion.

C9. The aerosol-forming article of any of clause C7 or clause C8, wherein the cooling segment includes at least a portion having a central bore with a cross-sectional area that forms a central region extending around the central axis and each of the plurality of bores has a center that is arranged radially outside of the central region.

C10. The aerosol-forming article of any of clause C7 to clause C9, wherein the cooling segment includes a portion comprising a spacer element having a central bore with a diameter greater than 95% of the diameter of an external surface of said portion comprising the spacer element.

C11. The aerosol-forming article of any of clauses C1 to C10, wherein a total cross-sectional area of the plurality of bores is less than 15% of the cross-sectional area of the filter segment or less than 10% of the cross-sectional area of the filter segment or around 6% of the cross-sectional area of the filter segment.

C12. A system comprising a smoking substitute article according to any one of clauses C1 to C11 and a device comprising a heating element.

C13. The system according to clause C12 wherein the device comprises a main body for housing the heating element and the heating element comprises an elongated heating element.

C14. A method of using the system according to clause C12 or C13, the method comprising:

inserting the article into the device; and heating the article using the heating element.

C15. A method according to clause C14 comprising inserting the article into a cavity within a main body of the device and penetrating the article with the heating element upon insertion of the article.

What is claimed is:

1. An aerosol-forming article comprising an aerosol-forming substrate and a filter segment, the filter segment having a plurality of bores extending there through, wherein a cooling segment is arranged upstream of the filter segment, the cooling segment comprising a portion having a central bore that forms a central region extending around a central axis of the aerosol-forming article and a centre of each bore of the plurality of bores is arranged radially outside of the central region, wherein the filter segment is the greatest restriction to airflow between the aerosol-forming substrate and a mouthpiece end of the aerosol-forming article.

2. The aerosol-forming article of claim 1, wherein each bore of the plurality of bores are open to the exterior at the mouthpiece end of the aerosol-forming article.

3. The aerosol-forming article of claim 2, wherein the filter segment comprises a body and the plurality of bores extend from one distal face of the body to an opposed distal face of the body.

4. The aerosol-forming article of claim 3, wherein the distal face arranged at a downstream end of the filter segment coincides with the mouthpiece end of the aerosol-forming article.

5. The aerosol-forming article of claim 1, wherein the filter segment has an elongate form having a central axis and each bore of the plurality of bores extends parallel to the central axis.

6. The aerosol-forming article of claim 1, wherein each bore of the plurality of bores has a circular cross-section that is constant along the length of the filter segment.

7. The aerosol-forming article of claim 1, wherein the diameter of the central bore of the portion of the cooling segment has a diameter between 40% and 45% of a diameter of an external surface of said portion.

8. The aerosol-forming article of claim 1, wherein the centres of each bore of the plurality of bores of the filter segment are arranged equally spaced about a notional circle.

9. The aerosol-forming article of claim 1, wherein said portion is a first portion and the cooling segment includes a second portion having a larger airflow passage than an airflow passage created by the central bore of the first portion.

10. The aerosol-forming article of claim 9, wherein the second portion comprises a spacer element having a central bore with a diameter greater than 95% of the diameter of an external surface of said portion comprising the spacer element.

11. The aerosol-forming article of claim 1, wherein a total cross-sectional area of the plurality of bores is less than 20% of the cross-sectional area of the filter segment, or wherein a total cross-sectional area of the plurality of bores is less than 15% of the cross-sectional area of the filter segment or less than 10% of the cross-sectional area of the filter segment or around 6% of the cross-sectional area of the filter segment.

12. A system comprising an aerosol-forming article according to claim 1 and a device comprising a heating element.

13. The system according to claim 12 wherein the device comprises a main body for housing the heating element and the heating element comprises an elongated heating element.

14. A method of using the system according to claim 12, the method comprising:

inserting the article into the device; and heating the article using the heating element.

15. A method according to claim 14 comprising inserting the article into a cavity within a main body of the device and penetrating the article with the heating element upon insertion of the article.

* * * * *